United States Patent [19]

Widerker

[11] Patent Number: 4,570,993

[45] Date of Patent: Feb. 18, 1986

[54] POCKET CHAIR

[76] Inventor: Martin Widerker, Botnanger Steige 10, 7000 Stuttgart 1, Fed. Rep. of Germany

[21] Appl. No.: 576,938

[22] Filed: Feb. 6, 1984

[30] Foreign Application Priority Data

Feb. 12, 1983 [DE] Fed. Rep. of Germany ..... 3304933
Aug. 6, 1983 [DE] Fed. Rep. of Germany ..... 3328490

[51] Int. Cl.[4] ..... A47C 4/00

[52] U.S. Cl. ..... 297/17; 297/54; 108/112; 108/35

[58] Field of Search ..... 297/17, 54, 16; 108/112, 115, 86, 67, 35; 248/188.6, 439

[56] References Cited

U.S. PATENT DOCUMENTS

| | | | |
|---|---|---|---|
| 328,990 | 10/1885 | Webster | 108/35 |
| 329,903 | 11/1885 | Hogeland | 108/35 |
| 393,890 | 12/1888 | Dolliver | 108/86 |
| 898,597 | 9/1908 | Pattinson | 297/54 |
| 1,444,569 | 2/1923 | Starkweather | 248/188.6 |
| 1,585,661 | 5/1926 | Gallaud | 108/35 |
| 2,652,300 | 9/1955 | Graber et al. | 108/112 |
| 2,903,313 | 9/1959 | Block | 108/112 |

FOREIGN PATENT DOCUMENTS 744192 2/1956 United Kingdom .

*Primary Examiner*—Francis K. Zugel
*Attorney, Agent, or Firm*—Burns, Doane, Swecker & Mathis

[57] ABSTRACT

A pocket chair has two sections which are pivoted by a pivot axle to each other and which can be swung open to an aligned condition to define a seating surface. Legs are extended from the sections to support the seating surface above the ground. Each chair section has a portion which carries the pivot axle. The remaining portions of each section are movable in an extending manner relative to the axle-carrying portions, whereby the seating area can be enlarged. The legs can comprise a plurality of U-shaped pieces which fold into one another. Further, the legs of one section can be inserted into the legs of the other section when the chair is folded up.

7 Claims, 10 Drawing Figures

POCKET CHAIR

BACKGROUND AND OBJECTS OF THE INVENTION

The invention concerns a pocket chair with a seating surface comprising two partial seating surfaces in the form of open box sections, pivoting relative to each other around a common axle, and with support legs pivotably attached to the box sections and housed in the folded state in said box sections.

A pocket chair of this type is known for example from British Pat. No. 744,192, published Feb. 1, 1956. The pocket chair described therein comprises two open box sections foldable against each other, and of telescopic legs that may be inserted into each other and folded into the inside of said box sections.

Such a pocket chair may be folded into a relatively small size. It has, however, the disadvantage that the seating surface consisting of the extended box sections is very small. If, on the other hand, the size of the box sections is increased to provide a larger seating surface, the dimensions of the folded pocket chair will also be larger.

It is an object of the invention to provide a pocket chair of the afore-described type, so that an adequately large and comfortable seating surface is provided, while the dimensions of the folded pocket chair are very small, so that the chair may be carried comfortably.

SUMMARY OF THE INVENTION

This object is attained by making that portion of each box section which carries the pivot axle as being extensible with respect to the remaining portions of the box section. In the chair according to the invention, therefore, the box sections may be extended further after their opening by virtue of their mobile portions, so that a larger seating surface is obtained than when unfolded as compared with the seat of British Pat. No. 744,192, even when, for example, the same folded-up dimensions are involved.

It is convenient to equip each of the box sections with a slidable insert attached in an extendable manner. Thus, the inserts form seating surface parts when in an extended mode. It is advantageous to provide the inserts with the configuration of an open box section in order to achieve, with only a slight design and mechanical effort, an adequate and satisfactory increase in the seating surface.

A further advantageous embodiment of the invention provides that the mobile portions be extracted by means of hinged levers. Depending on the specific layout, the seating surface may be increased further with respect to the first form of embodiment. It is convenient, for example, to articulate to the lateral parts of the box section two levers each and to rotatingly join the levers. These levers act as scissors, as it were, thereby rendering possible an increase of the seating surface of the open pocket chair by the simplest means. The scissors forming a part of the seating surface may be covered conveniently, for example with a width of cloth (not described in detail), which is part of the pocket chair and may be fastened to it. In order to provide the open scissors with adequate stability, the levers articulated to the box sections may be given a U-shaped profile and the levers articulated onto the lateral parts of T-shaped profile, wherein the U-shaped levers in the closed state accept a leg each of the T-shaped levers associated with them. Thus, it is readily possible to interchange the U-shaped and T-shaped levers.

In order to obtain good space utilization in the box sections and thus small dimensions of the folded pocket chair, it may be appropriate further to provide the partial pieces of each of the support legs with a U-shaped profile, wherein the U-shaped partial pieces of each of the support legs are pivotingly supported with respect to each other and are folded against each other in the closed state. These partial pieces of the support legs may be placed pivotingly against each other, wherein it is of particular advantage to have the open sides of the U-shaped partial pieces in the folded state point into the direction away from the bottoms of the box sections. A particularly good space utilization with a fill factor of nearly 100 percent is obtained when the legs of the U-shaped partial pieces of the folded support legs are of a height greater than the depth of the box section and when in the folded state, the legs of a folded support leg articulated onto a box section are projecting at least in part into the U-shape of the folded support legs articulated onto the opposite box section. The folded support legs arranged in each of the box sections thus are also given a U-profile, with the U-shapes of one-half of a box section fitting into the U-shapes of the other half.

THE DRAWING

Further characteristics and advantages of the pocket chair according to the invention will become apparent from the dependent claims and the description with reference to the drawing, representing preferred forms of embodiment of the invention. In the drawing:

DETAILED DESCRIPTION OF PREFERRED EMBODIMENTS OF THE INVENTION

Figure 1:
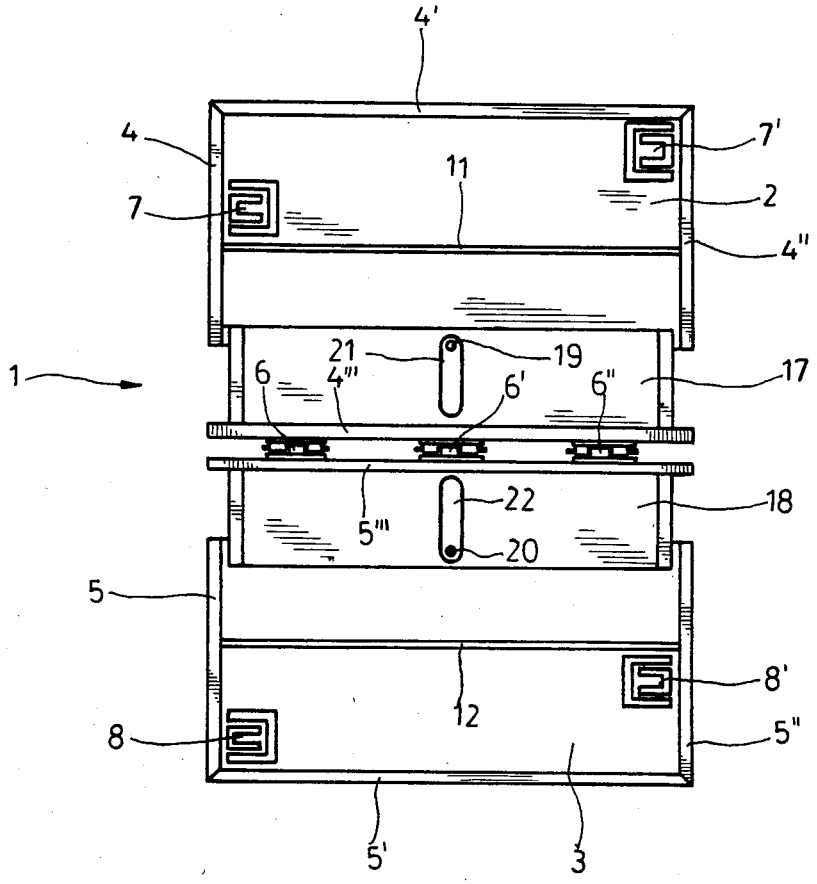
FIG. 1 shows a bottom view of a first embodiment of an open pocket chair according to the invention, wherein box sections serving as the seating surface are opened (unfolded) and the support legs pivoted out, and wherein the box sections are equipped with an extractable insert fastened to them and also having a box-like profile.
Figure 5:
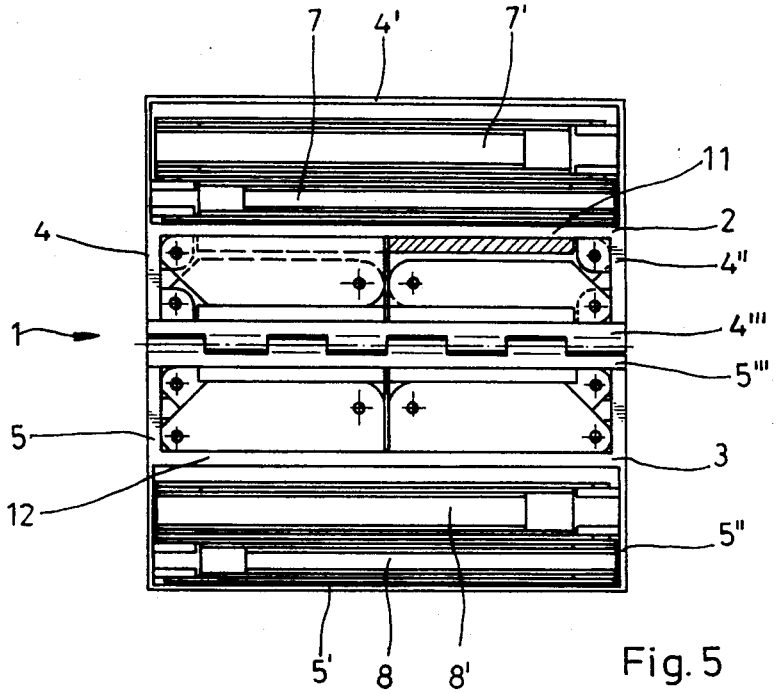
FIG. 5 depicts a third embodiment of the pocket chair according to the invention in the folded condition of the support legs and the scissors, wherein the support legs comprise three partial pieces each and are given a U-shaped profile and wherein the open sides of these U-profiles point in the same direction in the folded state.
Figure 6:
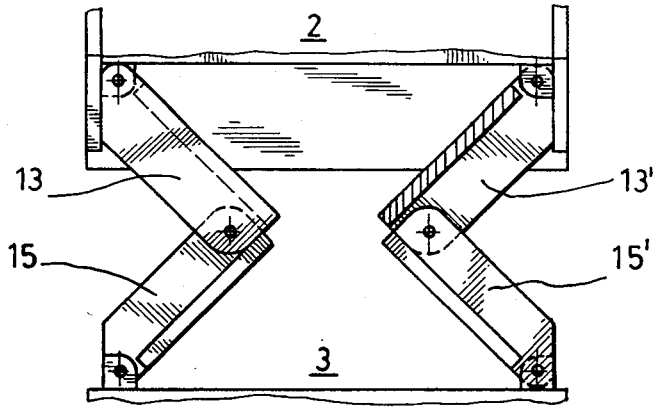
FIG. 6 depicts two of the scissors of FIG. 5 in the open condition.

A pocket chair according to the invention, designated in its entirety by numeral 1 in FIG. 1, comprises two partial seating surfaces in the form of box sections 2 and 3. The box-like profile is obtained by means of lateral parts 4—4''' and 5—5''', respectively, and is of a very small height. The two partial seating surfaces are connected with each other by means of coaxial hinges 6, 6' and 6''. With the support legs 7, 7'; 8, 8' in a folded state, the box sections 2, 3 may be pivoted around these hinges, whereby the thus folded-up pocket chair attains the shape of a flat case closed on all sides (FIG. 5). To secure together the two halves of the case in such a closed condition, a known fastening device (not shown in detail), for example a hook, may be provided. When the box sections are unfolded (FIG. 1), the user sits upon both box sections.

Figure 10:
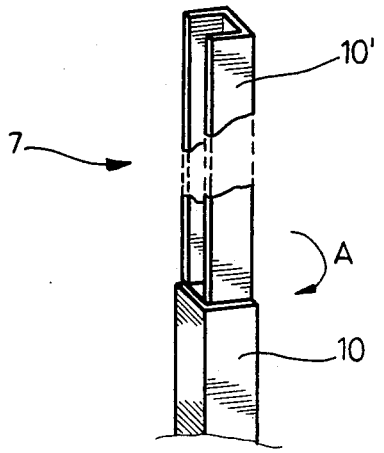
FIG. 10 is a partial view of an opened support leg in perspective.

The two support legs 7, 7' and 8, 8' are arranged in each of the two box profiles 2 and 3 in a pivoting manner. In the embodiment shown in FIG. 1, each of the support legs comprises two U-shaped profiles, which may be connected with each other pivotingly for example by means of a hinge (not shown). An example of a partial view of an open support leg may further be seen in FIG. 10, where the example of the support leg 7 illustrates that it may comprise two U-shaped profiles 10 and 10', wherein the part 10' may be pivotably folded in the direction of the arrow A into the part 10. The parts 10 and 10' may be secured against each other in the open state in a known manner, for example by a sliding bracket which is moved to overlie the pivot joint between the parts 10, 10'.

It is further seen in FIG. 1 that the lateral parts 4''' and 5''' of the box sections 2 and 3 which carry the pivot axle are mobile and extractable with respect to the remaining portions of the box sections. For this purpose, box-like inserts 17 and 18 are provided, to which the lateral parts 4''' and 5''' are movably fastened. The inserts 17, 18 and the lateral parts 4''' and 5''' attached to them may be extended with respect to the remaining box portions to enlarge the seating area. For this purpose, for example, pins 19 and 20 attached to the parts 2 and 3 may be provided; with the pins moving in corresponding guide slots 21 and 22 of the box inserts 17, 18. In the open condition, therefore, a seating surface larger than the base surface area of the box section is obtained. If desired, fasteners (not shown), may be provided for securing the inserts in the open condition. In the folded state the inserts 17 and 18 are completely telescoped in the remaining portions of the associated box sections, yielding a very good space utilization in the folded chair. The areas of the box sections 2 and 3 associated with the inserts 17 and 18, may be separated from the areas intended for the support legs 7, 7' and 8, 8' by partitions 11 and 12.

Figure 2:
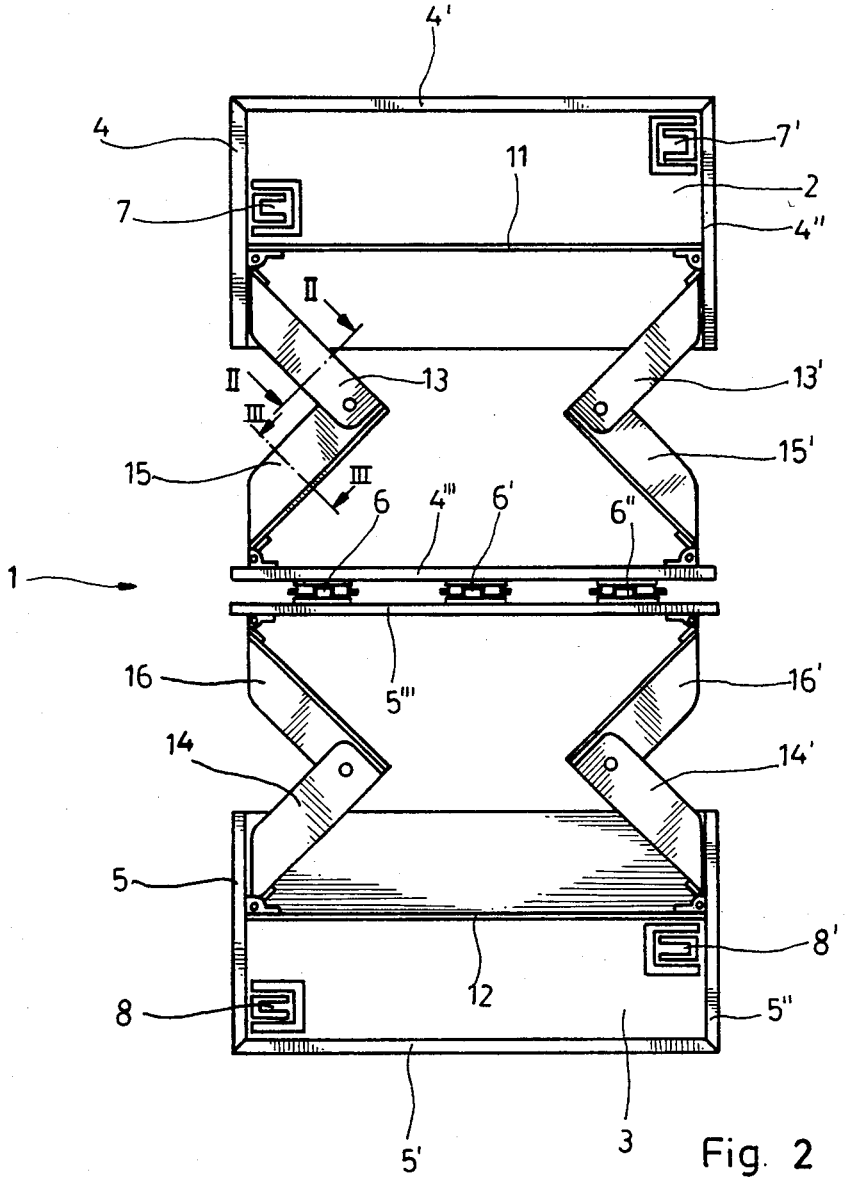
FIG. 2 depicts a second embodiment, wherein the lateral parts of the two box sections facing the pivot axle have been pivoted out by means of levers joined in a scissor-like manner, to obtain a larger seating surface.

A further embodiment of the invention is shown in FIG. 2. Instead of the inserts 17 and 18, levers 13 and 13' and 14 and 14', respectively, are pivotably connected to the box sections. Those levers are rotatably connected with further levers 15 and 15' and 16 and 16', which in turn, are pivotably connected to mobile lateral parts 4''' and 5''' of the box sections. Those lateral parts 4''' and 5''' carry the hinges 6, 6', 6''. The lever pairs 13/15, 13'/15', 14/16 and 14'/16' thus form a scissors type of hinge whereby the seating surface of the pocket chair according to the invention may be increased. Depending on the configuration of the levers, the seating surface may be increased in an almost arbitrary manner. Obviously, the part of the seating surface formed by the scissors or levers may be covered with cloth or the like to obtain a more comfortable seated position, wherein the said cloth or the like may be part of the pocket chair and may be attached to it.

During the folding of the pocket chair in the embodiment according to FIG. 2, the scissors formed by the levers may be pushed together and the levers, together with the support legs may be inserted in the box profiles 2 and 3. This again yields a configuration of the novel pocket chair that is very space saving in the folded state, which when opened, provides a comfortable and adequate seating surface.

Figure 3:
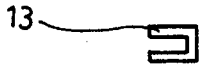
FIG. 3 is a sectional view taken along the reference line II—II in FIG. 2.
Figure 4:
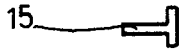
FIG. 4 is a sectional view taken along the reference line III—III of FIG. 2.

A favorable guidance of the levers forming the scissors is obtained when one of the two levers forming a pair has a U-shaped profile, into which a leg of the other T-shaped lever is inserted in the folded state. In the embodiment shown in FIG. 2, the levers 13, 13', 14, and 14' have U-shaped profiles (FIG. 3), while the levers 15, 15', 16 and 16' are provided with T-shaped profiles (FIG. 4). It is feasible to interchange the arrangement of the U- and T-shaped profiles of the levers. A configuration of this type provides adequate stability of the scissor assembly in the open state.

A third embodiment of the invention is shown in FIGS. 5 to 9. In FIG. 5, the pocket chair is shown in a bottom view with the box sections having been swung open but with the scissors not extracted and the support legs still folded. The levers forming the scissors are not numbered in FIG. 5 for the sake of clarity and are again shown in FIG. 6 with their reference numbers.

Figure 7:
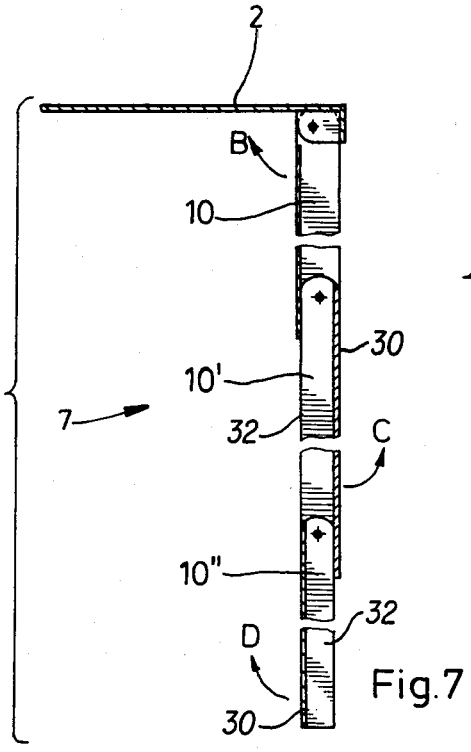
FIG. 7 is a sectional view taken through a three part support leg according to the embodiment of FIG. 5 in the open state.
Figure 8:
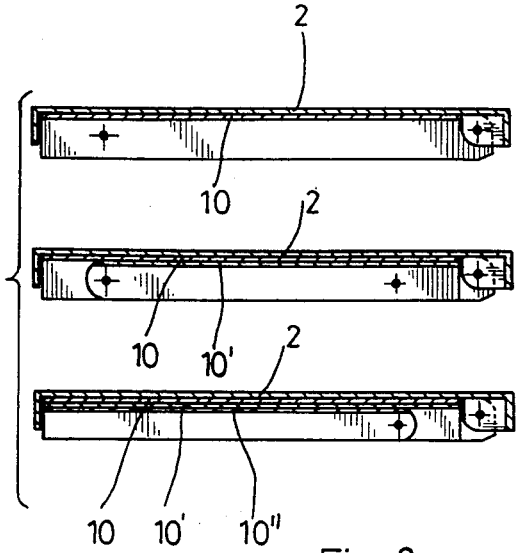
FIG. 8 depicts the different stages of the folding of a support leg according to FIG. 7.

The essential difference here with respect to the second embodiment (FIGS. 2 to 4) of the invention resides in the support legs being composed of three partial pieces or segments 10, 10', 10'' having U-shaped profiles, and the legs of these U-shapes being higher than the depth of the associated box sections. Each segment includes a first part 30 and a pair of second parts 32. When the segments are folded up, the first parts are parallel and the second parts are parallel. In FIG. 7, the structure of the three partial pieces 10 to 10''' of the support leg 7 are shown. The directions in which the pieces 10, 10', 10'' are folded are indicated by the arrows B, C and D. The individual stages of the folding of the support leg are also shown in FIG. 8.

Figure 9:
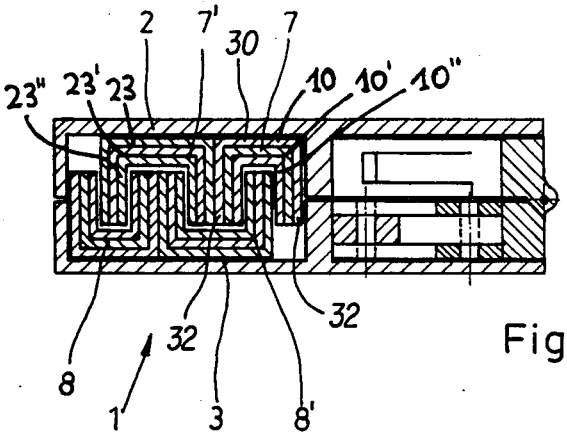
FIG. 9 is a sectional view taken through a folded pocket chair according to the third embodiment.

A cross-section through the folded pocket chair is shown in FIG. 9. It is seen here that the U-shaped partial pieces of each support leg are folded into each other so that the openings of the U-shapes are pointing in the same direction, i.e., outwardly. As the height of the legs of the U-shapes is greater than the depth of the corresponding box sections 2 and 3, the legs of the support legs on top are projecting into i.e., intermesh with, the U-shapes on bottom, and vice versa. Thus, the second parts 32 associated with each box section project toward and enter the other box section. As is readily seen, the space available for the chair leg is used in an optimum manner. In the cross-section, a fill factor of nearly 100 percent is obtained. The pocket chair according to the invention, therefore, may be folded into a very small shape, in spite of the adequate height of the legs and a sufficiently large seating surface.

The partial pieces 10, 10' and 10'' of the support legs are pivotingly interconnected so that in the open state the center piece 10' is located with the open side of the U-shape opposite the partial pieces 10 and 10''. After the folding of the chair, all of the open sides of the U-shapes are pointing in the same direction. The profiles are coordinated with each other so that the partial piece 10'' is received within the piece 10' and this in turn within the partial piece 10.

The support legs articulated onto a box section are additionally offset laterally with respect to the support legs attached to the other box section. In the embodiment of FIG. 9, for example, the support legs 7 and 7' are offset to the right with respect to the support legs articulated onto the box section 3. In addition, the cross-sections of the two support legs attached to a box section are different. According to FIG. 9, the support leg 7' is broader than the support leg 7 with respect to the cross-piece of corresponding U-shapes. The same relationship is naturally true for the corresponding partial pieces of these support legs; i.e., the partial piece 23 of the leg 7' is wider than the piece 10 of the leg 7, the piece 23' wider than the piece 10, and the piece 23'' wider than the piece 10''. (Similar conditions exist with respect to the legs 8 and 8'.) The space available for the chair legs is thereby utilized almost completely, as seen in FIG. 9, with the exception of two small "corners" to the left on top, and to the right at the bottom the cross-section displays ideal space utilization. The folded pocket chair therefore has an adequate height of the legs in spite of extremely small external dimensions.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A foldable pocket chair comprising:

a pair of open-sided box sections each including a seating surface situated opposite an open side of said box section, said box sections being pivotably secured together for being unfolded wherein said seating surfaces are generally coplanar, and folded-up wherein said open sides face one another, a plurality of support legs pivotably secured to each of said box sections, each said support leg comprising a plurality of segments pivoted together to be foldable into one another when said first and second box sections are folded-up, each of said segments comprising first and second mutually bent parts arranged such that when each support leg is folded said first parts thereof are generally parallel and disposed within the associated one of said box sections, and said second parts thereof are generally parallel and project toward and into the other of said box sections, said second parts of each of said box sections being offset and generally parallel relative to said second parts of the other box section when said box sections and said support legs are folded-up.

2. A foldable pocket chair according to claim 1, wherein each of said segments is generally U-shaped in cross-section and comprises two said second parts interconnected by said first part, said segments of each support leg being foldable such that the open sides of all segments associated with each box section face toward the other box section, said leg segments being arranged such that when the box sections are folded-up said open sides of said segments associated with each box section intermesh with the open sides of said segments associated with the other box section.

3. A foldable pocket chair according to claim 1, wherein each support leg comprises three said segments.

4. A foldable pocket chair according to claim 1, wherein said box sections are pivotably interconnected by a common axle, each of said box sections including an axle carrying portion, said axle carrying portions each including an insert movable into and from a remaining portion of the associated box section to form an extension of the seating surface thereof.

5. A foldable pocket chair according to claim 4, wherein each said insert is connected to said remaining portion of the associated box section by hinge means.

6. A foldable pocket chair according to claim 5, wherein each of said hinge means comprises two first levers pivotably connected to said insert and two second levers pivotably connected to said remaining portion, said first levers being pivotably connected to said second levers.

7. A foldable pocket chair according to claim 6, wherein said second levers have U-shaped profiles and said first levers have T-shaped profiles, said U-shaped levers each receiving a portion of a T-shaped lever when said box sections are folded-up.

* * * * *